US007675498B2

(12) United States Patent
Ku

(10) Patent No.: US 7,675,498 B2
(45) Date of Patent: Mar. 9, 2010

(54) DOT-INVERSION DISPLAY DEVICES AND DRIVING METHOD THEREOF WITH LOW POWER CONSUMPTION

(75) Inventor: Ksuan-Chun Ku, Changhua County (TW)

(73) Assignee: TPO Displays Corp., Miao-Li County (TW)

( * ) Notice: Subject to any disclaimer, the term of this patent is extended or adjusted under 35 U.S.C. 154(b) by 901 days.

(21) Appl. No.: 11/458,700

(22) Filed: Jul. 20, 2006

(65) Prior Publication Data

US 2008/0018578 A1 Jan. 24, 2008

(51) Int. Cl.
*G09G 3/36* (2006.01)

(52) U.S. Cl. ..... 345/90; 345/100

(58) Field of Classification Search ..... 345/90, 345/100

See application file for complete search history.

(56) References Cited

U.S. PATENT DOCUMENTS

2004/0119704 A1 * 6/2004 Miyajima et al. ..... 345/204

* cited by examiner

*Primary Examiner*—Amr Awad
*Assistant Examiner*—Dennis P Joseph
(74) *Attorney, Agent, or Firm*—Thomas, Kayden, Horstemeyer & Risley

(57) ABSTRACT

Display devices with low power consumption. In the display device, and first and second data lines, first and second gate lines, first and second supplemental lines, first and second pixels are provided. In the first pixel, a first transistor comprises a first terminal coupled to the first data line and a control terminal coupled to the first gate line, and a first storage capacitor comprises a first terminal coupled to the second terminal of the first transistor and a second terminal coupled to the first supplemental line. In the second pixel, a second transistor comprises a first terminal coupled to the second data line, and a control terminal coupled to the second gate line, and a second storage capacitor comprises a first terminal coupled to the second terminal of the second transistor and a second terminal coupled to the second supplemental line.

11 Claims, 4 Drawing Sheets

100

DOT-INVERSION DISPLAY DEVICES AND DRIVING METHOD THEREOF WITH LOW POWER CONSUMPTION

BACKGROUND OF THE INVENTION

1. Field of the Invention

The invention relates to display devices, and in particular to display devices with low power consumption and high aperture ratio.

2. Description of the Related Art

Liquid crystal displays (LCDs) are used in a variety of applications including calculators, watches, color televisions, computer monitors, and many other electronic devices. Active matrix LCDs are a well known type of LCD. In a conventional active matrix LCD, each picture element (or pixel) is addressed using a matrix of thin film transistors (TFT) and one or more capacitors. The pixels are arranged and wired in an array having a plurality of rows and columns. For example, a SVGA display is a matrix of 2400×600 pixels.

To address a particular pixel, the proper row is switched "on" (i.e., charged with a voltage), and a voltage is sent down the correct column. Since other intersecting rows are turned off, only the TFT and capacitor at the particular pixel receives a charge. In response to the applied voltage, the liquid crystal within the cell of the pixel changes its rotation and tilt angle, and thus, the amount of light is absorbed or passing therethrough. This process is then repeated row by row.

In liquid crystal cells of a pixel, the magnitude of applied voltage determines the amount of light is absorbed or passing therethrough. Due to the nature of liquid crystal material, the polarity of the voltage applied across the liquid crystal cell must alternate. Therefore, for an LCD displaying video, the voltage polarity applied to the liquid crystal cells is inverted (or reversed) on alternate frames of the video. This process is known as inversion.

Unfortunately, if the polarity of the entire LCD is inverted with the same polarity on alternate frames, the LCD flickers at an unacceptable level. Hence, many conventional LCDs use other forms of inversion, such as line inversion or dot inversion. In line inversion, alternate columns or rows of an LCD are inverted on alternate frames (e.g., in a "striped" pattern). Dot inversion inverts alternate pixels of each row and column alternate frames (e.g., in a "checkerboard" pattern). Of the two inversion techniques, dot inversion is generally considered to produce higher display quality.

However, inversion, especially dot inversion, increases power consumption of the LCD, since the data lines behave as a capacitive load (and may also include a storage capacitor), and thus, consume power as their voltages change polarity. Since LCDs are often used in battery powered or low power devices, many LCDs use driving methods optimized for power consumption. For example, many LCDs use line inversion rather than dot inversion.

Accordingly, it is desirable to develop display devices and driving methods with low power consumption.

BRIEF SUMMARY OF THE INVENTION

A detailed description is given in the following embodiments with reference to the accompanying drawings.

Embodiments of display devices are disclosed, in which first and second data lines, first and second gate lines, first and second supplemental lines, and first and second pixels are provided. In the first pixel, a first transistor comprises a first terminal coupled to the first data line, and a control terminal coupled to the first gate line and a first storage capacitor comprises a first terminal coupled to a second terminal of the first transistor and a second terminal coupled to the first supplemental line. In the second pixel, a second transistor comprises a first terminal coupled to the second data line, a control terminal coupled to the second gate line and a second storage capacitor comprises a first terminal coupled to a second terminal of the second transistor and a second terminal coupled to the second supplemental line.

The invention also provides another embodiment of a display device, in which a plurality of data lines DLm, first and second gate lines, first and second supplemental lines, a plurality of pixels arranged in a matrix, and a vertical driver are provided, wherein m is from 1 to n. Each pixel comprises a transistor and a storage capacitor, the transistor comprises a control terminal coupled to a corresponding gate line, and the storage capacitor comprises a first terminal coupled to a second terminal of the transistor, and a second terminal coupled to a corresponding supplemental line, wherein the storage capacitors in $M^{th}$ and $M+1^{th}$ rows of pixels share the first and second supplemental lines. The vertical driver scans the first gate line and the second gate in sequence and changes the polarity on the first and second supplemental lines after scanning the second gate line.

The invention also provides driving methods for display devices, in which the disclosed display device is provided, the first and second gate lines are scanned in sequence, and polarity on the first and second supplemental lines are switched after the second gate line is scanned.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
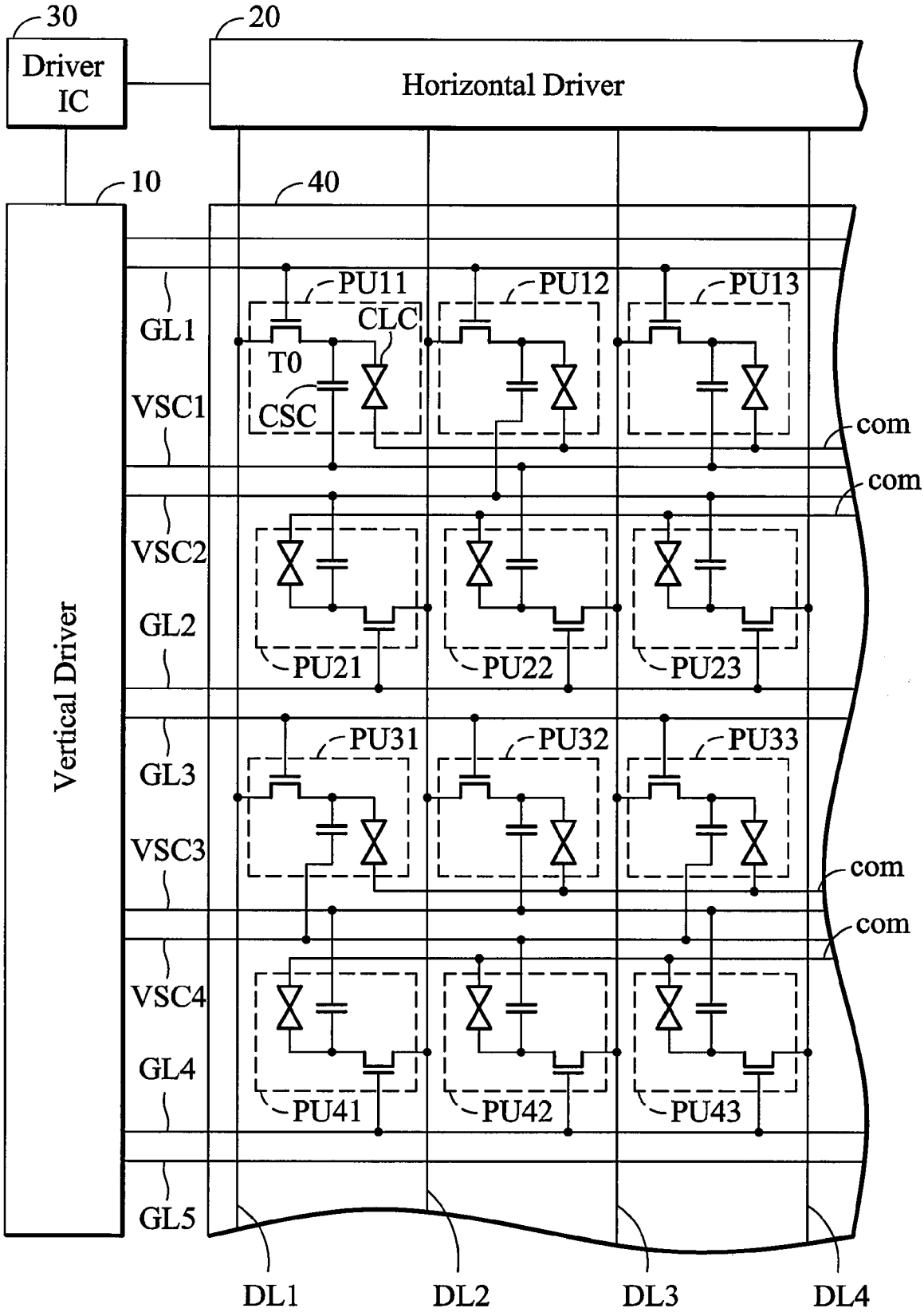
FIG. 1 shows an embodiment of a display device.

FIG. 1 shows an embodiment of a display device of the invention. As shown, the display device comprises a vertical driver 10, a horizontal driver 20, a driver integrated circuit (IC) 30, a pixel array 40, data lines DL1~DL4, scan lines GL1~GL5, and supplemental lines VSC1~VSC4. The pixel array 40 comprises a plurality of pixels PU11, PU12, PU13, . . . , each pixel comprises a transistor T0, a liquid crystal element CLC and a storage capacitor CSC. In each pixel, the switching transistor T0 comprises a control terminal coupled to a corresponding gate line, a first terminal coupled to a corresponding data line and a second terminal coupled to a storage capacitor CSC and a liquid crystal element CLC. The storage capacitor CSC comprises a first terminal coupled to the second terminal of the transistor T0 and a second terminal coupled to a corresponding supplemental line. The liquid crystal element CLC comprises a first terminal coupled to the second terminal of the transistor T0 and a second terminal coupled to a common electrode COM.

The storage capacitors CSC in $M^{th}$ and $M+1^{th}$ rows of pixels share two supplemental lines. For example, in the first row of pixels, such as PU11~PU13, control terminals of the transistors T0 are coupled to the first gate line GL1, first terminals of the transistors T0 are coupled to the data lines DL1~DL3 respectively, the storage capacitors in the odd-numbered pixels, such as PU11 and PU13, are coupled to the supplemental line VSC1, and the storage capacitors CSC in the even-numbered pixel, such as PU12 is coupled to the supplemental line VSC2. In the second row of pixels, such as PU21~PU23, control terminals of the transistors T0 are coupled to the second gate line GL2, first terminals of the transistors T0 are coupled to the data lines DL2~DL4 respectively, the storage capacitors CSC in the odd-numbered pixels, such as PU21 and PU23, are coupled to the supplemental line VSC2, and the storage capacitors CSC in the even-numbered pixels, such as PU22, is coupled to the supplemental line VSC1.

In the third row of pixels, such as PU31~PU33, control terminals of the transistors T0 are coupled to the third gate line GL3, first terminals of the transistors T0 are coupled to the data lines DL1~DL3 respectively, the storage capacitors in the odd-numbered pixels, such as PU31 and PU33, are coupled to the supplemental line VSC4, and the storage capacitors CSC in the even-numbered pixel, such as PU32, are coupled to the supplemental line VSC3. In the fourth row of pixels, such as PU41~PU43, control terminals of the transistors T0 are coupled to the second gate line GL4, first terminals of the transistors T0 are coupled to the data lines DL2~DL4 respectively, the storage capacitors CSC in the odd-numbered pixels, such as PU41 and PU43, are coupled to the supplemental line VSC3, and the storage capacitors CSC in the even-numbered pixels, such as PU42, is coupled to the supplemental line VSC4.

The driver IC 30 directs the vertical driver 10 and the horizontal driver 20 to drive the pixels in the pixel array 40. For example, the horizontal driver 20 provides data signals, such as voltage signals, to the pixels in the pixel array 40 through the data lines DL1~DL4 when gate lines GL1~GL5 are scanned in sequence by the vertical driver 10.

In this embodiment, the horizontal driver 20 provides first (negative) polarity data through the data lines DL1 and DL3 and second (positive) polarity data through the data lines DL2 and DL4 in a $N^{th}$ frame, and provides the second (positive) polarity data through the data lines DL1 and DL3 and the first (negative) polarity data through the data lines DL2 and DL4 in a $N+1^{th}$ frame. Due to connection of the pixels in the pixel array 40, the negative polarity data on the data lines DL1 and DL3 can be output to the pixels PU11, PU13, PU22, PU31, PU33 and PU42, and the positive polarity data on the data lines DL2 and DL4 can be output to pixels PU12, PU21, PU23, PU32, PU41 and PU43 during the $N^{th}$ frame. During the $N+1^{th}$ frame, the positive polarity data on the data lines DL1 and DL3 can be output to the pixels PU11, PU13, PU22, PU31, PU33 and PU42, and the negative polarity data on the data lines DL2 and DL4 can be output to pixels PU12, PU21, PU23, PU32, PU41 and PU43. Thus, pixels in the display device 100 can be driven using dot-inversion.

The vertical driver 10 scans the gate lines GL1~GL5 in sequence and provides voltage signals to the supplemental lines VSC1~VSC4 during a frame period. The vertical driver 10 further switches the polarity of the voltage signals on the supplemental lines VSCn and VSCn+1 after the corresponding two gate lines are scanned in sequence, such that the polarity on the supplemental lines VSCn and VSCn+1 is changed.

Figure 2:
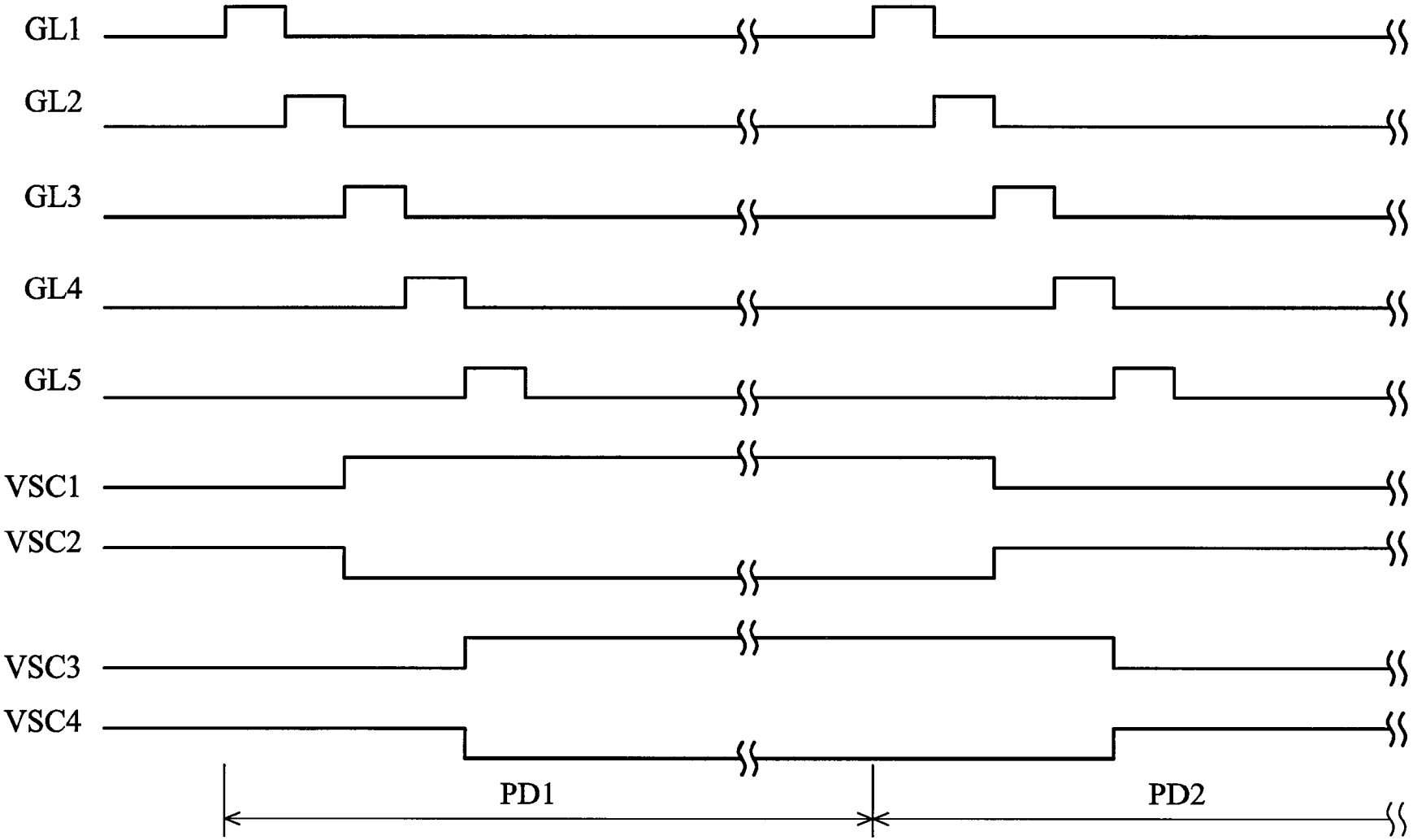
FIG. 2 shows a timing chart of a vertical driver.

FIG. 2 shows a timing chart of the vertical driver 10. As shown, the gate lines GL1~GL5 are scanned in sequence during period PD 1, the polarity on the supplemental lines VSC1 and VSC2 are changed after the gate line GL2 is scanned, and the polarity on the supplemental lines VSC3 and VSC4 is changed after the gate line GL4 is scanned. The supplemental lines VSC1 and VSC2 are changed to negative polarity and positive polarity respectively until the gate line GL2 is scanned in the next period PD2. Similarly, the supplemental lines VSC3 and VSC4 are changed to negative polarity and positive polarity respectively until the gate line GL4 is scanned in the next period PD2. The invention changes the polarity on the supplemental lines VSC1 and VSC2 after the gate line GL2 is scanned, such that the voltage signals stored in the pixels PU11~PU33 can be corrected by capacitor coupling. Similarly, the polarity on the supplemental lines VSC3 and VSC4 is changed after the gate line GL4 is scanned, such that the voltage signals stored in the pixels PU21~PU23 can be corrected by capacitor coupling.

Figure 3:
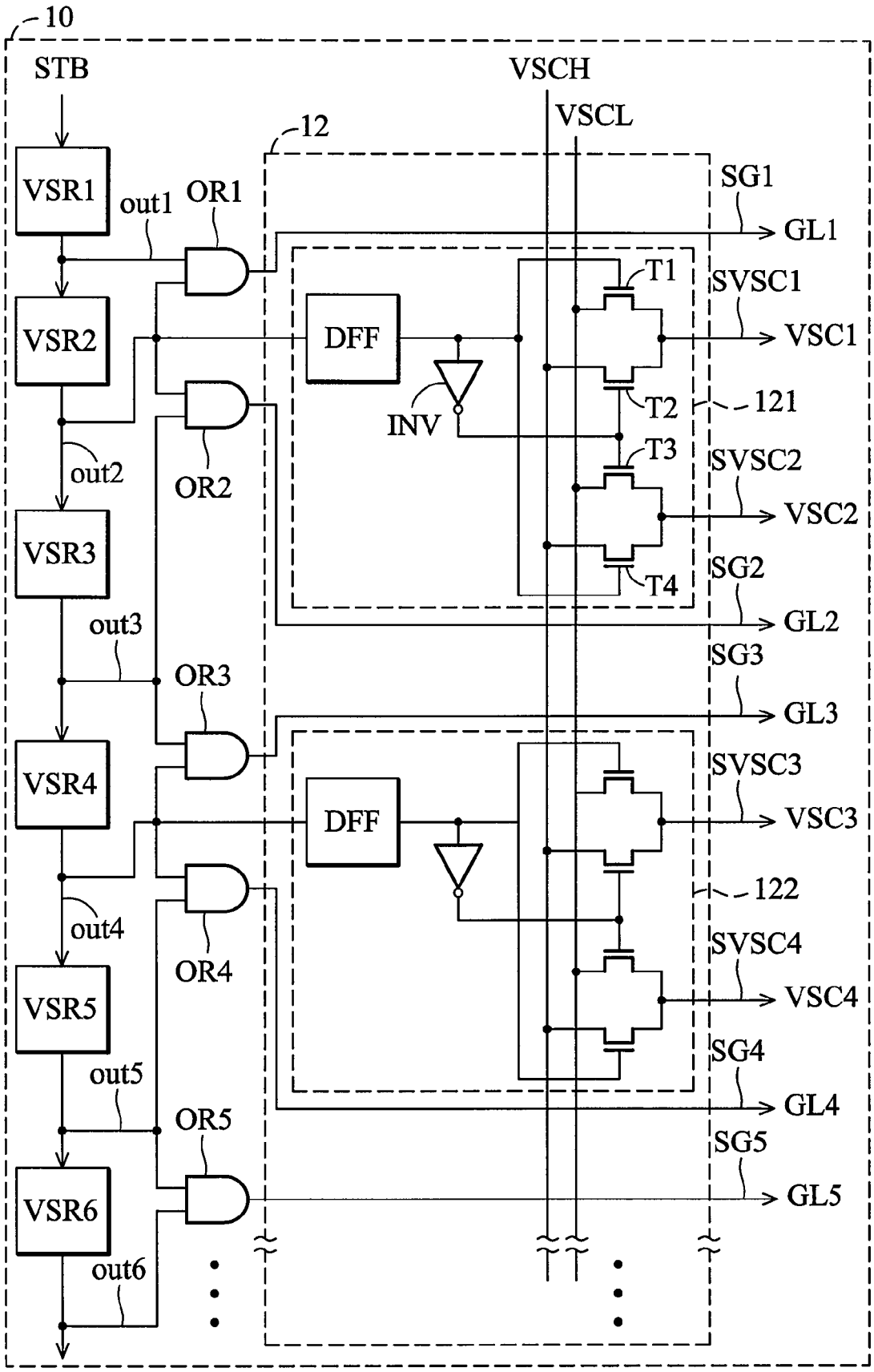
FIG. 3 shows an embodiment of a vertical driver.

FIG. 3 shows an embodiment of a vertical driver 10. As shown, the vertical driver 10 comprises a plurality of shift registers VSR1~VSR6 connected in series, a plurality of OR gates OR1~OR5, and a signal supply circuit 12. The shift register VSR1~VSR6 generates output pulses out1~out6 in sequence according to a start pulse STP, and the OR gates OR1~OR5 generate scan signals SG1~SG5 to scan the gate lines GL1~GL5 in sequence according to the output pulse out1~out6. For example, OR gate OR1 generates the scan signal SG1 according to output pulses out1 and out2 from the shift registers VSR1 and VSR2, the OR gate OR2 generates the scan signal SG2 according to the output pulses out2 and out3 from the shift registers VSR2 and VSR3, the OR gate OR3 generates the scan signal SG3 according to the output pulses out3 and out4 from the shifter registers VSR3 and VSR4, and so on.

The signal supply circuit 12 generates voltage signals with negative polarity and positive polarity, changing the polarity of the voltage signals on the supplemental lines VSC1~VSC4 according to the output pulses out2 and out4 from even-numbered shift registers VSR2 and VSR4. The signal supply circuit 12 comprises a plurality of generation units 121 and 122, each comprising a D-type flip-flop DFF, an inverter NV, and four transistors T1~T4.

In generation unit 121, the D-type flip-flop DFF comprises an input terminal coupled to the output pulses out2 from the shifter register VSR2, and the inverter INV comprises an input terminal coupled to an output terminal of the D-type flip-flop DFF. Transistor T1 comprises a control terminal coupled to the output terminal of the D-type flip-flop DFF, a first terminal coupled to a logic signal VSCL, and a second terminal coupled to the supplemental line VSC1. The transistor T2 comprises a control terminal coupled to the output terminal of the inverter INV, a first terminal coupled to a logic signal VSCH, and a second terminal coupled to the supplemental line VSC1. The transistor T3 comprises a control terminal coupled to the output terminal of the inverter INV, a first terminal coupled to the logic signal VSCL, and a second terminal coupled to the supplemental line VSC2. The transistor T4 comprises a control terminal coupled to the output terminal of the D-type flip-flop DFF, a first terminal coupled to the logic signal VSCH, and a second terminal coupled to the supplemental line VSC2. For example, the logic signal VSCL may be a negative polarity voltage signal, and the logic signal VSCH may be a positive polarity voltage signal.

Generation unit 122 is similar to the generation unit 121, except that the input terminal of the D-type flip-flop DFF is coupled to the output pulse out4 of the shift register VSR4, second terminals of the transistors T1 and T2 are coupled to the supplemental line VSC3 and second terminals of the transistors T3 and T4 are coupled to the supplemental line VSC4.

For example, in the beginning, the transistors T1 and T4 may be turned on by the output of the D-type flip-flop DFF and the transistors T2 and T3 may be turned off by the output of the inverter INV in the generation units 121 and 122, such that the logic signal VSCL (negative polarity) serves as signals SVSC1 and SVSC3, output to the supplemental lines VSC1 and VSC3 respectively and the logic signal VSCH (positive polarity) serves as the signals SVSC2 and SVSC4, output to the supplemental lines VSC2 and VSC4 respectively.

When receiving the output pulse out2, the D-type flip-flop DFF in the generation unit 121 inverts output signal thereof, such that transistors T1 and T4 are turned off and transistors T2 and T3 are turned on. Thus, the logic signal VSCH (positive polarity) serves as the signal SVSC1, output to the supplemental line VSC1, and the logic signal VSCL (negative polarity) serves as the signal SVSC2, output to the supplemental line VSC2. Similarly, when receiving the output pulse out4, the D-type flip-flop DFF in the generation unit 122 inverts output signal thereof, such that the transistors T1 and T4 are turned off and the transistors T2 and T3 are turned on. Thus, the logic signal VSCH (positive polarity) serves as the signal SVSC3, output to the supplemental line VSC3, and the logic signal VSCL (negative polarity) serves as the signal SVSC4, output to the supplemental line VSC4. It should be noted that the polarity of the signals SVSC1 and SVSC2 should be inverted after the gate line GL2 is scanned. Similarly, the polarity of the signals SVSC3 and SVSC4 should be inverted after the gate line GL4 is scanned, and so on.

In the invention, two rows of pixels in the display device 100 share a pair of signal lines, for example, the first and second rows of pixels share supplemental lines VSC1 and VSC2, and third and fourth rows of pixels share supplemental lines VSC3 and VSC4 and so on. Namely, in the display device 100, one row of pixels requires one supplemental line VSC and conductive lines on the pixel array 40 is reduced, such that the display device 100 has a higher aperture ratio. Furthermore, the display device 100 can be driven by dot-inversion, polarity switching on the data lines is reduced, and thus, power consumption can be reduced.

Figure 4:
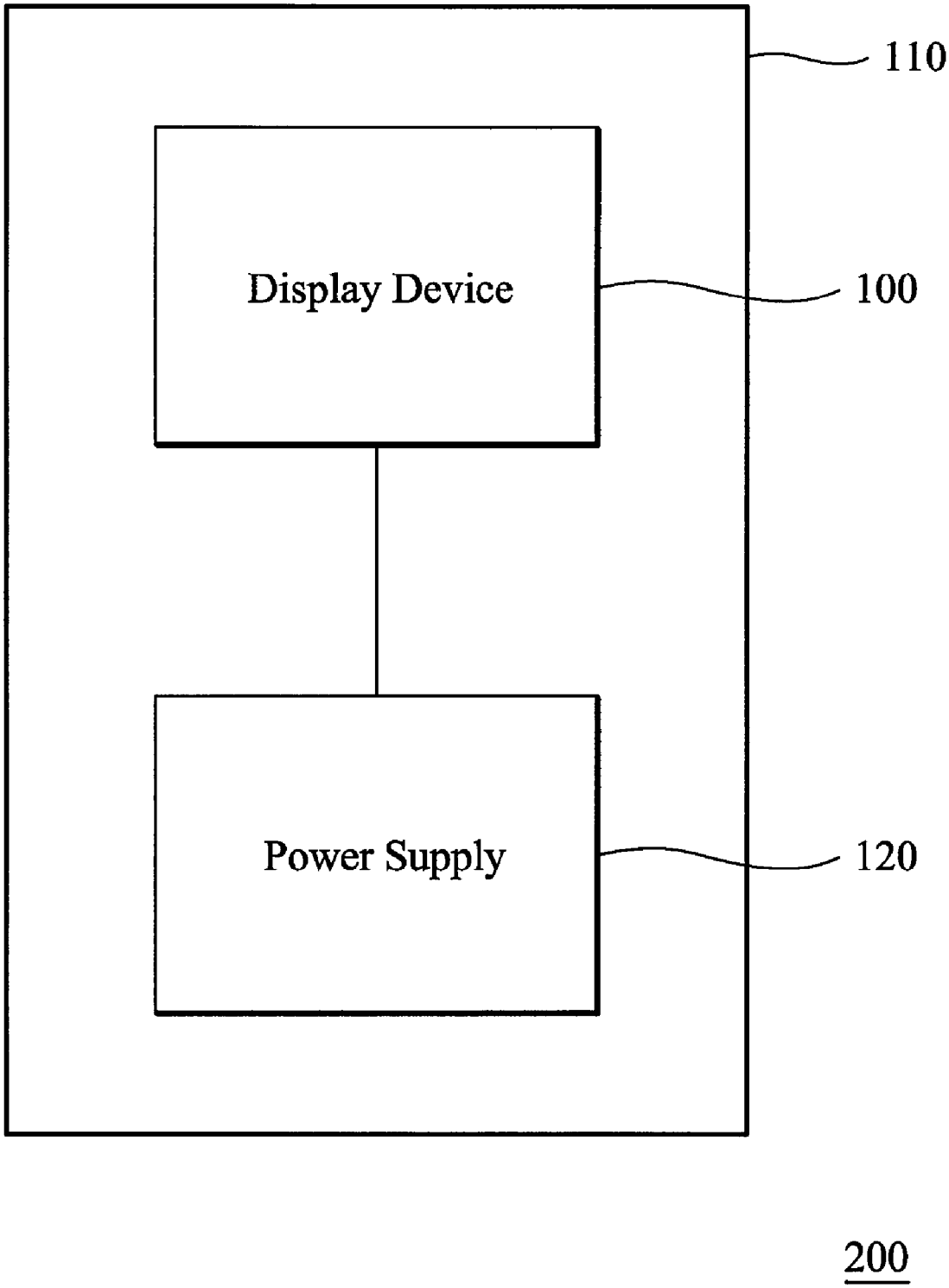
FIG. 4 schematically shows an embodiment of an electronic device.

FIG. 4 schematically shows an embodiment of an electronic device. In particular, electronic device 200 employs the display device 100 shown in FIG. 1. The electronic device 200 may be a device such as a PDA, digital camera, notebook computer, tablet computer, cellular phone or a display monitor device, for example.

Electronic device 200 comprises a housing 110, a display device 100 and a power supply 120, although it is to be understood that various other components can be included, not shown or described here for ease of illustration and description. In operation, the power supply 120 powers the display device 100 to display color images.

While the invention has been described by way of example and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

first, second and third data lines;

first and second gate lines;

first and second supplemental lines;

a first pixel comprising:

a first transistor comprising a first terminal coupled to the first data line, a control terminal coupled to the first gate line and a second terminal; and a first storage capacitor comprising a first terminal coupled to the second terminal of the first transistor and a second terminal coupled to the first supplemental line;

a second pixel comprising:

a second transistor comprising a first terminal coupled to the second data line, a control terminal coupled to the second gate line and a second terminal; and a second storage capacitor comprising a first terminal coupled to the second terminal of the second transistor and a second terminal coupled to the second supplemental line, wherein the first and second pixels are in the same column;

a third pixel comprising:

a third transistor comprising a first terminal coupled to the second data line, a control terminal coupled to the first gate line and a second terminal; and a third storage capacitor comprising a first terminal coupled to the second terminal of the third transistor and a second terminal coupled to the second supplemental line;

a fourth pixel comprising:

a fourth transistor comprising a first terminal coupled to the third data line, a control terminal coupled to the second gate line and a second terminal; and a fourth storage capacitor comprising a first terminal coupled to the second terminal of the fourth transistor and a second terminal coupled to the first supplemental line; and a vertical driver providing a first signal with a negative polarity and a second signal with a positive polarity on the first and second supplemental lines respectively, scanning the first and second gate lines in sequence and switching the polarity of the first and second signals on the first and second supplemental lines after the second gate line is scanned, wherein the vertical driver comprises:

a plurality of shift registers generating output pulses in sequence according to a start pulse;

a plurality of AND gates generating scan signals to scan the first and second gate lines according to the output pulses from the shifter registers; and a signal supply circuit generating the first signals and the second signals and changing the polarity of the first and second signals on the first and second supplemental lines according to the output pulses from even-numbered shifter registers, wherein the signal supply circuit comprises a plurality of generation units, each comprising:

a D-type flip-flop comprising an input terminal coupled to one of the output pulses from the even-numbered shifter registers and an output terminal;

an inverter comprising an input terminal coupled to the output terminal of the D-type flip-flop and an output terminal;

a fifth transistor comprising a control terminal coupled to the output terminal of the D-type flip-flop, a first terminal coupled to a first logic signal, and a second terminal coupled to the first supplemental line;

a sixth transistor comprising a control terminal coupled to the output terminal of the inverter, a first terminal coupled to a second logic signal, and a second terminal coupled to the first supplemental line;

a seventh transistor comprising a control terminal coupled to the output terminal of the inverter, a first terminal coupled to the first logic signal, and a second terminal coupled to the second supplemental line; and an eighth transistor comprising a control terminal coupled to the output terminal of the D-type flip-flop, a first terminal coupled to the second logic signal, and a second terminal coupled to the second supplemental line.

2. The display device as claimed in claim 1, further comprising a data driver providing data signals to drive the first, second, third and fourth pixels.

3. The display device as claimed in claim 1, wherein the display device is a liquid crystal display device.

4. An electronic device, comprising:

a display device as claimed in claim 1; and a power supply powering the display device to display images.

5. The electronic device as claimed in claim 4, wherein the electronic device is a PDA, a digital camera, a display monitor, a notebook computer, a tablet computer, or a cellular phone.

6. A display device, comprising:

a plurality of data lines DLm, wherein m is from 1 to n;

first and second gate lines;

first and second supplemental lines;

a plurality of pixels arranged in a matrix, each pixel comprising:

a first transistor comprising a control terminal coupled to a corresponding gate line, a first terminal and a second terminal; and a storage capacitor comprising a first terminal coupled to the second terminal of the transistor, and a second terminal coupled to a corresponding supplemental line;

wherein the storage capacitors in Mth and M+1th rows of pixels share the first and second supplemental lines;

wherein, in the Mth row, control terminals of the first transistors are coupled to the first gate line, first terminals of the first transistors are coupled to the data lines DL1-DLn respectively, the storage capacitors in the odd-numbered pixels are coupled to the first supplemental line, the storage capacitors in the even-numbered pixels are coupled to the second supplemental line, and, in the M+1th row, control terminals of the first transistors are coupled to the second gate line, first terminals of the first transistors are coupled to the data lines DL2-DLn respectively, the storage capacitors in the odd-numbered pixels are coupled to the second supplemental line, the storage capacitors in the even-numbered pixels are coupled to the first supplemental line, wherein the odd-numbered pixels are in the same column, and a vertical driver scanning the first gate line and the second gate in sequence and changing the polarity on the first and second supplemental lines after scanning the second gate line, wherein the vertical driver comprises:

a plurality of shift registers generating output pulses in sequence according to a staff pulse;

a plurality of AND gates, generating scan signals to scan the first and second gate lines according to the output pulses from the shifter registers; and a signal supply circuit generating the first signals and the second signals and changing the polarity of the first and second signals on the first and second supplemental lines according to the output pulses from even-numbered shifter registers, wherein the signal supply circuit comprises a plurality of generation units, each comprising:

a D-type flip-flop comprising an input terminal coupled to one of the output pulses from the even-numbered shifter registers and an output terminal an inverter comprising an input terminal coupled to the output terminal of the D-type flip-flop and an output terminal;

a second transistor comprising a control terminal coupled to the output terminal of the D-type flip-flop, a first terminal coupled to a first logic signal, and a second terminal coupled to the first supplemental line;

a third transistor comprising a control terminal coupled to the output terminal of the inverter, a first terminal coupled to a second logic signal, and a second terminal coupled to the first supplemental line;

a fourth transistor comprising a control terminal coupled to the output terminal of the inverter, a first terminal coupled to the first logic signal, and a second terminal coupled to the second supplemental line; and a fifth transistor comprising a control terminal coupled to the output terminal of the D-type flip-flop, a first terminal coupled to the second logic signal, and a second terminal coupled to the second supplemental line.

7. The display device as claimed in claim 6, further comprising a data driver providing data signals to drive the plurality of pixels.

8. The display device as claimed in claim 6, wherein the display device is a liquid crystal display device.

9. An electronic device, comprising:

a display device as claimed in claim 6; and a power supply powering the display device to display images.

10. The electronic device as claimed in claim 9, wherein the electronic device is a PDA, a display monitor, a notebook computer, a tablet computer, or a cellular phone.

11. A driving method for a display device, comprising: providing a display device comprising:

a plurality of data lines DLm, wherein m is from 1 to n;

first and second gate lines;

first and second supplemental lines;

a plurality of pixels arranged in a matrix, each pixel comprising:

a first transistor comprising a control terminal coupled to a corresponding gate line, a first terminal and a second terminal;

a storage capacitor comprising a first terminal coupled to the second terminal of the transistor, and a second terminal coupled to a corresponding supplemental line;

wherein the storage capacitors in Mth and M+1th rows of pixels share the first and second supplemental lines;

wherein, in the Mth row, control terminals of the first transistors are coupled to the first gate line, first terminals of the first transistors are coupled to the data lines DL1-DLn respectively, the storage capacitors in the odd-numbered pixels are coupled to the first supplemental line, and the storage capacitors in the even-numbered pixels are coupled to the second supplemental line, and in the M+1th row, control terminals of the first transistors are coupled to the second gate line, first terminals of the first transistors are coupled to the data lines DL2-DLn respectively, the storage capacitors in the odd-numbered pixels are coupled to the second supplemental line, the storage capacitors in the even-numbered pixels are coupled to the first supplemental line, wherein the odd-numbered pixels are in the same column, and a vertical driver scanning the first gate line and the second gate in sequence and changing the polarity on the first and second supplemental lines after scanning the second gate line, wherein the vertical driver comprises:

a plurality of shift registers generating output pulses in sequence according to a start pulse;

a plurality of AND gates generating scan signals to scan the first and second gate lines according to the output pulses from the shifter registers; and a signal supply circuit generating the first signals and the second signals and changing the polarity of the first and second signals on the first and second supplemental lines according to the output pulses from even-numbered shifter registers, wherein the signal supply circuit comprises a plurality of generation units, each comprising:

a D-type flip-flop comprising an input terminal coupled to one of the output pulses from the even-numbered shifter registers and an output terminal;

an inverter comprising an input terminal coupled to the output terminal of the D-type flip-flop and an output terminal;

a second transistor comprising a control terminal coupled to the output terminal of the D-type flip-flop, a first terminal coupled to a first logic signal, and a second terminal coupled to the first supplemental line;

a third transistor comprising a control terminal coupled to the output terminal of the inverter, a first terminal coupled to a second logic signal, and a second terminal coupled to the first supplemental line;

a fourth transistor comprising a control terminal coupled to the output terminal of the inverter, a first terminal coupled to the first logic signal, and a second terminal coupled to the second supplemental line; and a fifth transistor comprising a control terminal coupled to the output terminal of the D-type flip-flop, a first terminal coupled to the second logic signal, and a second terminal coupled to the second supplemental line;

scanning the first and second gate lines in sequence; and changing the switching the polarity on the first and second supplemental lines after the second gate lines is scanned.

* * * * *